United States Patent [19]

Siebert

[11] Patent Number: 5,048,411

[45] Date of Patent: Sep. 17, 1991

[54] CALENDER, IN PARTICULAR FOR THE PRODUCTION OF PACKING SHEETS

[75] Inventor: Hermann Siebert, Sontra-Ulfen, Fed. Rep. of Germany

[73] Assignee: Paul Troester Maschinenfabrik, Hannover, Fed. Rep. of Germany

[21] Appl. No.: 508,253

[22] Filed: Apr. 12, 1990

[30] Foreign Application Priority Data

Apr. 14, 1989 [DE] Fed. Rep. of Germany ..... 3912303

[51] Int. Cl.[5] ..... B30B 15/34; B30B 3/04

[52] U.S. Cl. ..... 100/93 RP; 100/168; 100/170

[58] Field of Search ..... 100/93 RP, 47, 168–170

[56] References Cited

U.S. PATENT DOCUMENTS

| | | | |
|---|---|---|---|
| 2,611,150 | 9/1952 | Goulding, Jr. | 100/170 X |
| 2,854,700 | 10/1958 | Caspari et al | 100/170 X |
| 3,209,679 | 10/1965 | Crist et al. | 100/170 |
| 3,572,570 | 3/1971 | Mortensen | 100/170 X |

FOREIGN PATENT DOCUMENTS

| | | | |
|---|---|---|---|
| 1729821 | 10/1972 | Fed. Rep. of Germany | 100/170 |
| 1367497 | 6/1964 | France | 100/170 |
| 84340 | 2/1957 | Netherlands | 100/170 |
| 747347 | 4/1956 | United Kingdom | 100/170 |
| 766901 | 1/1957 | United Kingdom | 100/170 |

*Primary Examiner*—Harvey C. Hornsby
*Assistant Examiner*—Stephen F. Gerrity
*Attorney, Agent, or Firm*—Robert E. Burns; Emmanuel J. Lobato

[57] ABSTRACT

A calender, in particular for the production of packing sheets, comprises a heated cylinder of larger diameter and a cooled cylinder of smaller diameter. The larger diameter cylinder is rotatably supported in calender stands by bearings which are in fixed position on the stands. The smaller diameter cylinder is rotatably supported by bearings which are slidable in the calender stands so that the smaller diameter cylinder is movable toward and away from the larger diameter cylinder. The bearings of the smaller diameter cylinders are connected with a support beam which is slidable on the calender stands and is movable toward and away from the larger diameter cylinder by double-acting cylinder and piston units acting between the support beam and the stands. Counter-bending mechanism for the smaller diameter cylinder comprises double-acting hydraulic cylinder and piston units acting between the support beam and bearings on outer ends of projecting shaft position of the smaller diameter cylinder.

8 Claims, 2 Drawing Sheets

CALENDER, IN PARTICULAR FOR THE PRODUCTION OF PACKING SHEETS

FIELD OF THE INVENTION

The invention relates to a calender, in particular for the production of packing sheets, comprising at least two cylinders, at least one of which is adjustably supported in calender stands and is provided, with an anti-bending device.

BACKGROUND OF THE INVENTION

Such a calender is, for example, known from DE-PS 17 29 821. However, the calender here described has not yet been built.

As equalizing measures against the undesired bending of a cylinder, three possibilities are known: the curving of the cylinder, i.e. the convex ball form, the crossing, i.e. crossing the cylinder axes, counter-bending.

In all heretofore delivered packing sheet calenders the pressing cylinders have been ground curved. With other calenders, on the contrary, counter-bending devices and crossing installations have also come into operation.

The curvature is a constant value which is calculated to compensate for the bending with a predetermined loading or determined by practice. Gap force and curvature have a constant relation to one another. It thus results that with another loading, whether higher or lower, corresponding damage to the accuracy of the product results. However, because of variable sheet thickness and very different mixture compositions for different packing sheet use, the practice of packing sheet preparation requires different cylinder gap forces.

As the outer surface of the cylinder is subject to remarkable wear, which is greater in the middle of the cylinder than at the edges, the camber becomes constantly smaller with increased use of the cylinder. With increasing tolerance requirements for the product, the need of an adjustable correction device for the deflection becomes ever clearer.

The crossing of the cylinders is, on technical process grounds, unsuitable for a packing sheet calender.

Thus, of the two variable methods of compensating the deflection, there remains only the possibility of counterbending. Packing sheet calenders generally have two cylinders of different size, namely a large heated working cylinder, on which the packing sheet is constructed and thereby vulcanized and a smaller, usually cooled, pressing cylinder which applies pressure to the packing sheet. A counterbending is conceivable only on this smaller cylinder.

For a long time, the cylinder position of this pressing cylinder has been effected hydraulically, as definite cylinder forces, which are necessary for the sheet production, could not be obtained by mechanical positioning devices, for example with threaded spindles.

The counter-bending devices for the cylinders, which are per se known in calender construction, must, for their function, apply large forces, whereby the support mostly on the calender stands is effected. With the known construction of counter-bending devices, these large forces so greatly impair the cylinder pressure that their practical use in the construction of packing sheet calenders is practically prohibited. For when, with packing sheet calenders of known construction, a hydraulically actuated device for compensating cylinder bending acts on the thin cold cylinder in addition to the hydraulic pressing device, the bearing forces which are applied to the ends of the adjustable cylinder are added to the pressing forces. Through this fault, considerable rejects arise. The indicated value of the pressure measuring device no longer corresponds to the applied cylinder force. The calculation of the actual working pressure on the packing sheet being formed on the large heavy working cylinder is extraordinarily complicated and loaded with considerable uncertain factors.

DE-PS 17 29 821 proposes eliminating these disadvantages in that, contrary to the known and until now usual practice, the thinner and lighter cold cylinder, on which the counter-bending device works, is rotatably supported fast in the calender stands while the heavier and heated working cylinder is adjustable in the calender stand. However, with this construction, the adjustability of the large and very heavy working cylinder relative to the driving force transmission raises serious problems, in particular, syncronizing problems. Moreover, the adjustment of the large heavy working cylinder is disadvantageous in that because of the very high mass of this cylinder, the measuring of the adjustment forces is loaded in an undesirable manner with errors. The incident construction difficulties were so great that this construction of a packing sheet calender has not come into production.

Also known, from the construction of rubber or plastic material calenders is the combined use of cylinder curvature and counter-bending. The counter-bending device is then so constructed that the counter-bending can work in both directions, so as to provide a corresponding compensating adjustment for both larger and smaller gap forces. However, the different force directions of the counter-bending raises considerable problems in the construction of packing sheet presses so that also this combined art has not come into use.

SUMMARY OF THE INVENTION

The invention avoids the disadvantages of the state of the art. It is an object of the present invention so to construct a calender with the large heavy cylinder rotatably supported in fixed position in the calender stands, that the counter cylinder, which is arranged adjustable and provided with preferably hydraulic counter-bending mechanism, can be acted upon with definite and easily measurable forces.

The invention consists therein that in the calender stand there is provided a supporting beam with slidable bearings on which supports for the bearings of the cylinder provided with counter-bending devices as well as the counter-bending mechanism are mounted and on which the adjustment devices for the cylinder adjustment engage.

In accordance with the invention, the adjustment devices for the cylinder adjustment displace a supporting beam provided with counter-bending devices. Thus the counter-bending forces on the cylinder can be applied and measured independently of the adjustment forces. The adjustment forces, on the other hand, can be applied and measured independently of the counter-bending forces. With this arrangement, highly exact packing sheets can be produced. The expense of construction is easily controlled. As the large heavy hot cylinder of a packing sheet calender is rotatably supported in fixed position in the calender stands with this construction, the transmission of the driving forces to this large heavy cylinder presents no problem.

If the hot cylinder is designed curved, the counter-bending device is so designed that a positive as well as a negative bending of the counter cylinder is possible. In this case, it is advantageous when the counter-bending devices are double-working hydraulic cylinder and piston units in which the exposed piston surfaces have a ratio of one to two.

In order to be able to open the gap between the cylinders very quickly in the event of an accident, it is especially advantageous in this embodiment with a non-adjustable hot cylinder, when the axis of the cylinder provided with the counter-bending device and the carrier are arranged in a horizontal plane which lies below the horizontal plane which passes through the axis of the cylinder of which the bearings are fast in the calender stands. In this manner, gravity assists the opening of the cylinder gap.

For the charging of the material, it is especially advantageous when the cylinder axis and the carrier are arranged in an inclined plane.

BRIEF DESCRIPTION OF THE DRAWINGS

The invention will be more fully understood from the following description of a preferred embodiment shown schematically in the accompaning drawings in which.

DESCRIPTION OF PREFERRED EMBODIMENT

Figure 1:
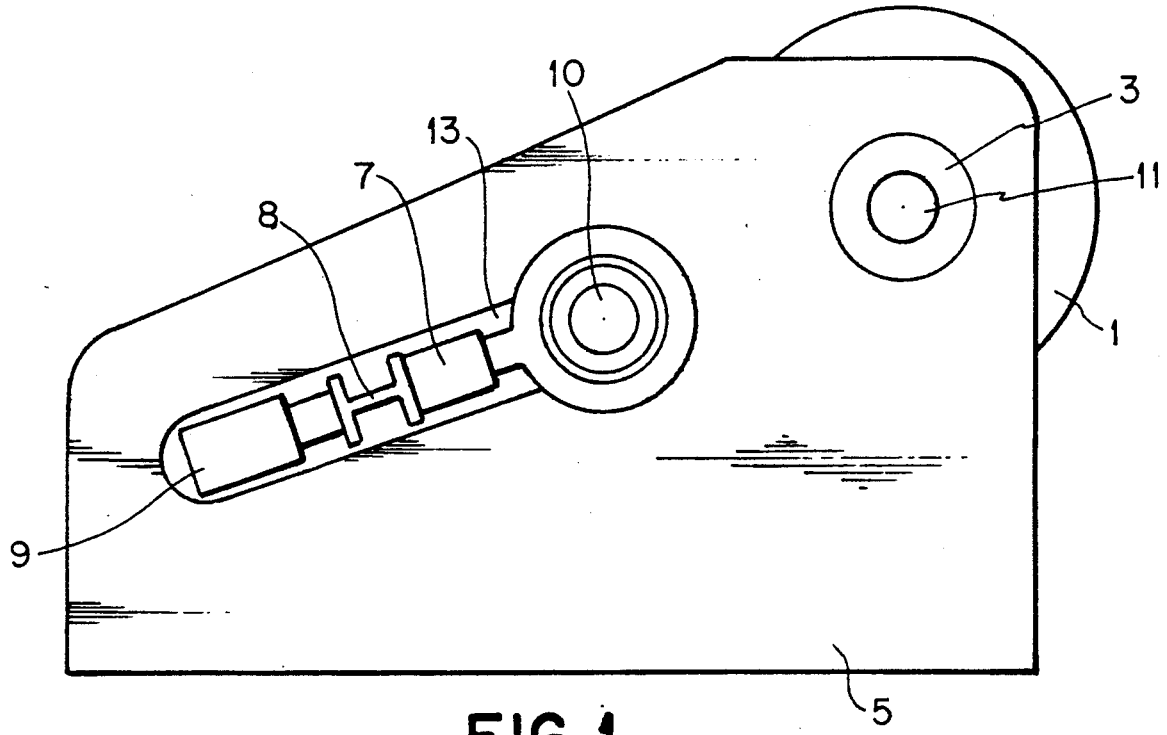
FIG. 1 is a side elevation of the calender
Figure 2:
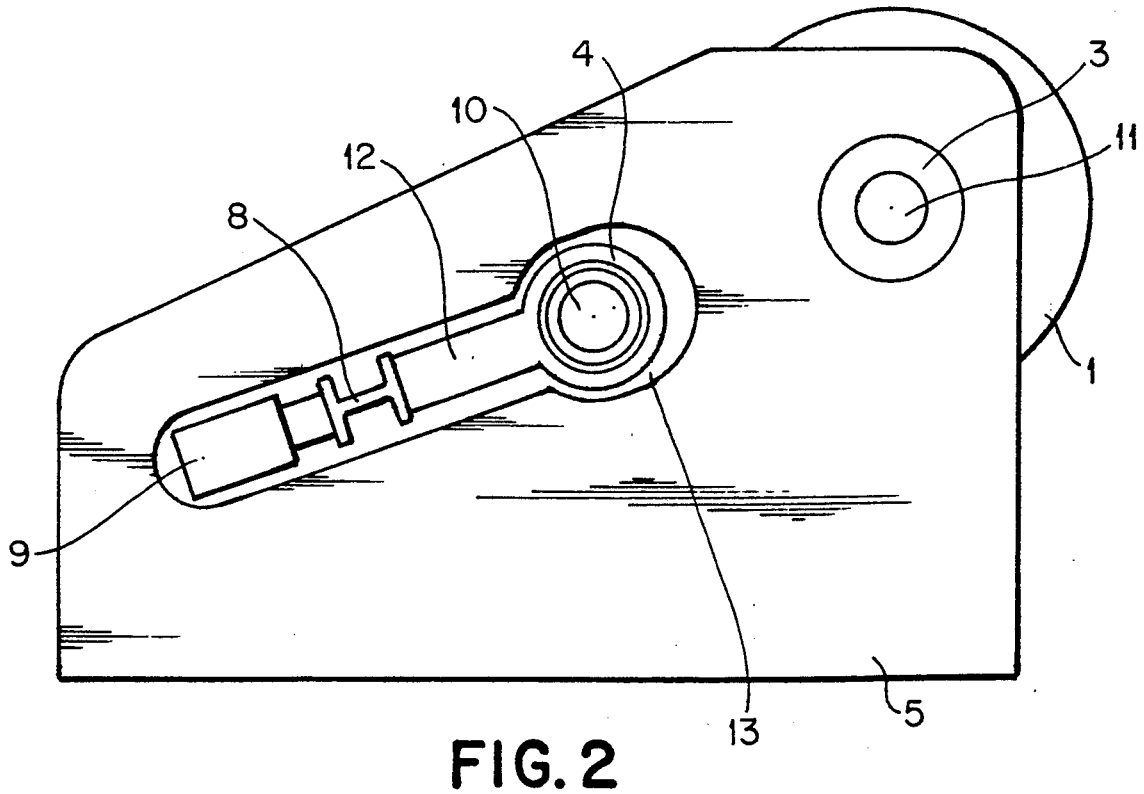
FIG. 2 is a side elevation of the calender after removal of the counter-bending device and FIG. 3 is a schematic sectional view.
Figure 3:
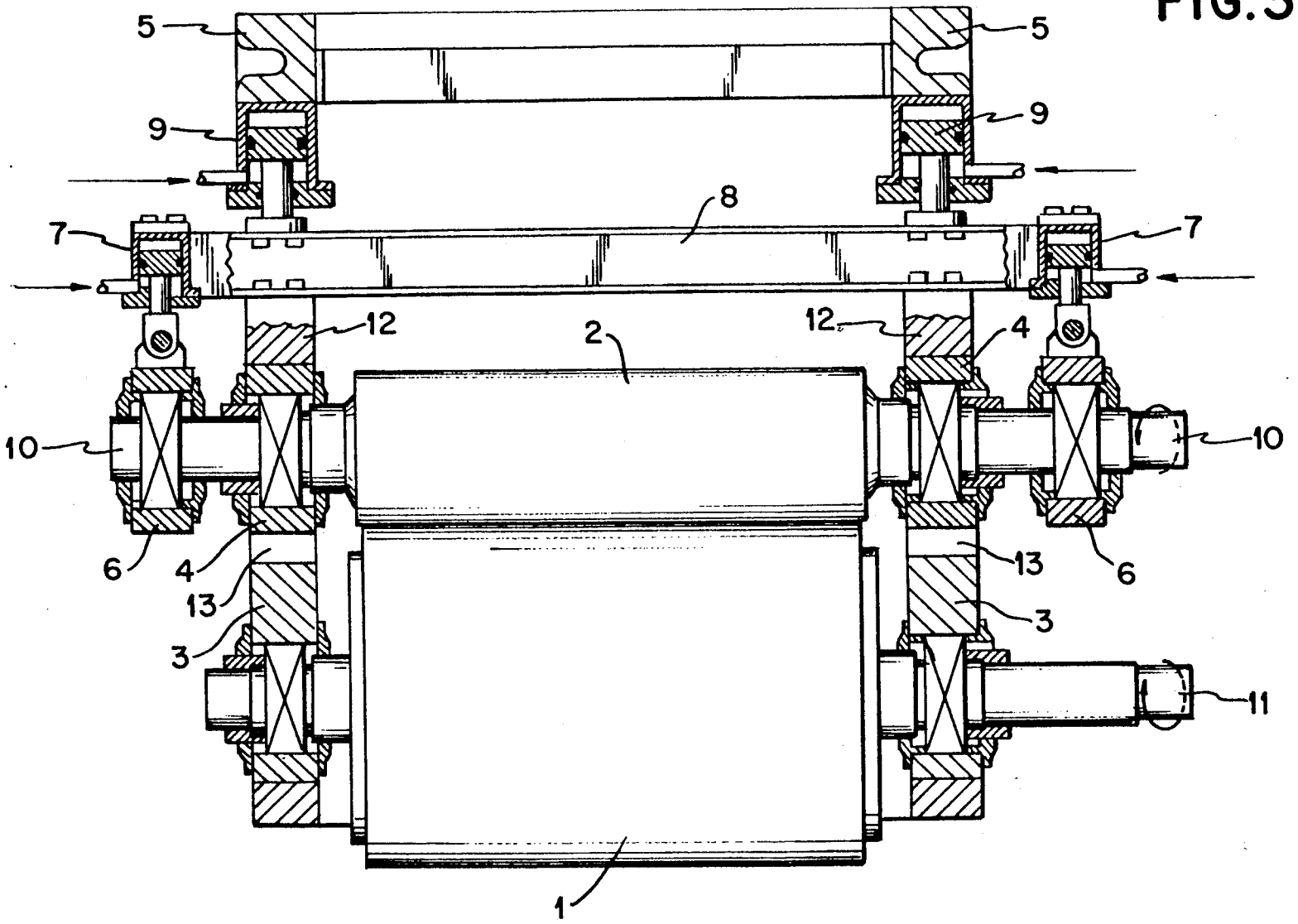

The packing sheet calender shown schematically by way of example in the drawings comprises a large, heavy, heated cylinder 1 and a smaller diameter and lighter cold or cooled counter-cylinder 2 which are rotatably supported by bearings 3 and 4 respectively. The bearings 3 of the hot cylinder 1 are supported in fixed position in the calender stands 5, while the bearings 4 are supported by a support 12 which is slidable in recesses 13 in the calender stands 5. This support 12 is secured to a supporting beam 8 which is likewise slidable in the recesses 13 of the calender stands. This supporting beam 8 carries on its outer ends hydraulic cylinder-piston units 7 of which the pistons are connected with bearings 6 on outer ends of outwardly projecting portions of the shaft 10 of the counter-cylinder 2. The bearings 6 and the hydraulic cylinder-piston units 7 form the counter-bending device. The piston rods of hydraulic cylinder-piston units 9 mounted on the calender stands 5 are connected with the supporting beam 8 and serve to position the counter-cylinder 2.

The counter-bending forces exerted by the cylinder-piston units 7 and acting on the projecting end portions of the cylinder shaft 10 are effective only in the region of the supporting beam 8, the counter-bending device 6, 7, the cylinder shaft 10 and the supports 12. Thus the counter-bending forces in no way exert any influence on the bearing forces of the shaft 11 of the working cylinder 1. The counter-bending forces are thus fully independent of the pressing forces which are exerted by the cylinder-piston units 9. These pressing forces exerted by the hydraulic cylinder-piston units 9 act, without any influence of the counter-bending forces, on the pressing cylinder 2 and press this cylinder against the working cylinder 1. Thereby the pressing forces can be precisely calculated and adjusted. Thus this installation can be equipped with a memory programmed control and the products produced on the installation can be produced in an exact reproducable manner.

It will be understood that since the hydraulic cylinder-piston units 7 are double acting, the shaft 10 and hence the cylinder 2 can be flexed selectively in opposite directions.

The invention is applicable not only to packing sheet calenders but also to other calenders with counter-bending devices.

I claim:

1. A calender, in particular for the production of packing sheets, comprising two spaced calender stands, two rotatable calender cylinders comprising a larger diameter cylinder and a smaller diameter cylinder, said cylinders having shafts which extend beyond the ends of the respective cylinders, first bearings secured in fixed position on said calender stands for rotatably supporting said larger diameter cylinder by its shaft, second bearings on said calender stands for rotatably supporting said smaller diameter cylinder, by its shaft, said second bearings being slidable on said calender stands for movement of said smaller diameter cylinder toward and away from said larger diameter cylinder, opposite end portions of said shaft of said smaller diameter cylinder extending beyond said second bearings, third bearings on said extended end portions of said shaft of said smaller diameter cylinder, said third bearings being spaced axially from said second bearings, a support beam slidable on said calender stands in a direction toward and away from said larger diameter cylinder, a pair of support members which are slidable in said calender stands respective and connect said second bearings fixedly with said support beam, means for moving said support beam toward and away from said larger diameter cylinder and thereby moving said smaller diameter cylinder toward and away from said larger diameter cylinder to vary a gap between said cylinders, and counter-bending means acting between opposite outer end portions of said support beam and said third bearings on said extended end portions of said shaft of said smaller diameter cylinder to counteract bending of said smaller diameter cylinder.

2. A calender according to claim 1, in which said counter-bearing means comprises double-acting hydraulic cylinder-piston units acting between opposite end portions of said support beam and said third bearings on said extended end portions of said shaft of said smaller diameter cylinder.

3. A calender according to claim 2, in which areas of opposite piston faces of said hydraulic cylinder piston units have a ratio of one to two.

4. A calender according to claim 1, in which said means for moving said support beam toward and away from said larger diameter cylinder comprise double-acting cylinder-piston units acting between said calender stands and said support beam.

5. A calender according to claim 1, in which the axis of said smaller diameter cylinder lies in a horizontal plane which lies below a horizontal plane in which the axis of said larger diameter cylinder lies.

6. A calender according to claim 5, in which the axes of said cylinders and said support beam are arranged in an inclined plane.

7. A calender according to claim 1 in which said larger diameter cylinder is heated.

8. A calender according to claim 7 in which said smaller diameter cylinder is cooled.

* * * * *